United States Patent [19]

Lapham

[11] 4,316,540

[45] Feb. 23, 1982

[54] NESTING OR STACKING BOX

[76] Inventor: Sidney D. Lapham, 2324-3 Tice Creek Dr., Walnut Creek, Calif. 94595

[21] Appl. No.: 44,086

[22] Filed: May 31, 1979

[51] Int. Cl.[3] ..... B65D 21/04

[52] U.S. Cl. ..... 206/507; 206/518

[58] Field of Search ..... 206/501, 505, 506, 507, 206/509, 515, 518

[56] References Cited

U.S. PATENT DOCUMENTS

| | | | |
|---|---|---|---|
| 2,742,181 | 4/1956 | Jarund | 206/507 |
| 2,889,072 | 6/1959 | Lapham | 206/507 |
| 3,191,796 | 6/1965 | Schwartz | 206/507 |
| 3,438,544 | 4/1969 | Cloyd | 206/507 |
| 3,773,213 | 11/1973 | Frederick | 206/507 |

*Primary Examiner*—George E. Lowrance

*Attorney, Agent, or Firm*—Burns, Doane, Swecker & Mathis

[57] ABSTRACT

Pairs of complementary open-top containers are disclosed that can be stacked, one upon the other without covers or reorientation of one of the pair relative to the other. Similarly formed containers of multiple pairs can be nested for storage or transportation as empties. A pair of complementary containers are of similar polygonal shape in which the sidewalls are formed as complementary approximations of sine waves (sinusoids) having similar amplitudes, but whose frequencies are spacially displaced sufficiently so that interference is created between the ingoing and outgoing portions of a sufficient number of half waves forming the wave train so that the bottom portions of such waves on one container land on the top of oppositely phased waves on the complementary container. In use of multiple sets of pairs similarly formed containers are identically marked or coded so that a workman (or automatic handling equipment) can readily identify whether a particular container will stack with another container of the pair, or nest with a similarly formed container. In preferred embodiments, square boxes and approximately circular pails illustrate the invention.

16 Claims, 8 Drawing Figures

NESTING OR STACKING BOX

FIELD OF INVENTION

This invention relates to nesting or stacking tote or lug boxes. More particularly, it relates to a system of open-top tote boxes that may be selectively nested with other boxes having similar side wall corrugations or stacked with complementary boxes of similar outer dimensions having dissimilar side wall corrugations without requiring reorientation of either box for selectively either stacking or nesting with another box in the system.

A principal object of this invention is to provide a system of two sets of polygonal, usually square, open-top tote or lug boxes that have similar outer dimensions. The side walls of both sets of boxes are formed with corrugations or undulations that are substantially identical, but the corrugations of one set are out of phase (in a spacial sense) with the other set. By coding the two sets, such as by forming the boxes of different colored materials (such as black and white plastic), the system permits nesting of like colored or distinctively coded boxes or stacking with different colored boxes. The purpose of such a system is to provide more efficient mechanical handling of filled boxes, such as in an orchard and at a cannery, by eliminating the need to reorient the boxes during handling and to reduce drastically both the number of hauls required to supply empty boxes to the field or orchard and the amount of space required to store empties. Further advantages of such a system of complementary boxes are that they are more suitable for cooling the contents of fruit filled boxes, and they are more sanitary throughout their operating life cycles.

BACKGROUND OF THE INVENTION

In my U.S. Pat. No. 2,889,072, there is disclosed square tote or lug boxes that may be switched from a nesting condition to a stack condition or vice versa, by rotation of either box 90 degrees about a vertical axis. Earlier systems using rectangular (as distinguished from square) boxes required rotation of 180 degrees (around a vertical axis through the box) to go from an initial stacking or nesting condition to the opposite position. The defects in the latter system are discussed in my above-mentioned patent. That patent also discusses in detail the advantages of using square boxes in a field or at a cannery during loading, trucking and unloading of such boxes.

The patent also discusses the advantages of handling of such boxes with a fork-lift truck without the need of bottom support pallets that are required with conventional, straight-sided wooden boxes. Specifically, the patent also describes the problems of handling rectangular boxes full of fruit that must be rotated 180 degrees about a vertical axis to go from a nesting to a stacking condition or vice versa. For such handling, it is necessary to pick up the box, rotate 90 degrees, set it down, pict it up again and rotate another 90 degrees. A particular advance of the patent over previous box systems was to require only one 90 degree rotation of any box to go from nesting to stacking or the reverse. However, errors could occur in attempts to nest or stack one box with the other since every box will both nest or stack.

In general, neither of the above discussed box rotation systems have become fully commercial over the past 20 years, even though these systems would have solved many of the basic storage and handling problems of pallet-supported wooden boxes. It is believed that a primary reason that commercial success was not achieved is the need to orient each box correctly either to stack or nest and the possibility of errors inherent in an uncoded system, whether the boxes are square, rectangular or other polygonal shapes. A particular disadvantage of conventional wooden boxes, either stacked on each other or loaded on pallets, occurs when they are full of soft fruits or vegetables that can be damaged if the boxes are misplaced in loading or shift during transportation. Under these conditions not only is the fruit damaged but also the tines of the fork lift frequently cannot gain access to the bottom of the box or the support pallet to right or unload the box. This then delays or ties up unloading until auxiliary equipment, usually another fork lift or a hoist, is brought in to complete unloading. The present invention clearly obviates these problems.

SUMMARY OF THE INVENTION

In carrying out this invention, two sets of complementary boxes are formed with the boxes within each set being substantially identical. All of the boxes of each set will nest with any other box of the same set. The boxes of one set will stack with any box of the other, or complementary set. In a preferred form, the outer dimensions, width, length and depth, as well as the polygonal forms of boxes in both sets are substantially identical.

To accomplish nesting, each box is formed with the the side walls vertically tapered so that the outer dimensions of the bottom of each box or container are slightly smaller, e.g., width, length and circumference, than the open top. Desirably, but not necessarily each box includes stop members extending inwardly from the external side walls and near the top. These stop members prevent an upper box from frictionally wedging inside a lower box.

To stack a box of one set on a box of the complementary set, each box in both sets is constructed with the vertically tapered side walls formed as corrugations or undulations that approximate a spacial train of sine wave form. These sine waves have a spacial amplitude and spacial wave length which is small relative to the overall length of a side wall and large relative to the thickness of the side wall. But each box of one set has the spacial waves forming its side walls of sufficiently different phase or frequency so that substantial interference is created between the inward and outward corrugations of the boxes from complementary, or different, sets. Preferably, in square boxes such spacial wave trains are 180 degrees out of phase with each other so that each half wave of the complementary boxes interferes with each other to form sets of lands or flats along the top of each side wall that will support the interfering bottom edges of an upper box resting on the top edge of the lower box.

To assure stacking or nesting, each set of boxes is coded differently. In a preferred form, this coding is visual, usually by color, such as all black for one set and all white for the other. Alternatively, other forms of coding or marking can be used whether visual or otherwise readily sensable either electrically or mechanically (as by automatic sensing equipment).

In a preferred embodiment, the top of each open box terminates in a lip member forming a flat surface surrounding or enveloping the outer periphery of each undulation. It thereby fully encloses the area under the inwardly going portion of each undulation. The lip member also extends outwardly from the side wall of the box to form a bottom lift or grip surface for raising or lowering the box, with, for example, the tines of a fork lift truck. Additionally, the upper edge of the lip member is desirably formed with step means inclined outwardly from the inner edge toward the outermost edge of the corrugations or undulations in each side. Thus, each box stacked on a complementary box will be held against shifting by the sloped outward going undulations in the bottom of the top box registering with the similarly outwardly inclined step formed by the inwardly going undulations on the lip of the bottom box.

In a preferred form, the corrugations of each side are effectively square waves with slight rounding at the corners of each maximum or minimum amplitude excursion. A highly advantageous feature of the square wave configuration of the side walls is in effecting rapid heat exchange through the walls to cool ripe fruit or vegetables in the box. During harvest time ripe produce is frequently subject to rapid deterioration after picking, either while awaiting transportation or during a relatively long haul to a cannery or processing plant in hot summer weather. Where immediate packing is not possible or inconvenient, it is also desirable to hold fruit, such as apples, pears, plums, apricots or peaches, under refrigeration for prolonged periods. Rapid cooling by forced air movement over the produce through the substantially increased area formed by convolutions in side walls of boxes constructed in accordance with this invention greatly improves this early preservation. In hauling such filled boxes on open bed trucks or trailers, highway speed of the truck will produce this cooling effect. Forced flow of refrigerated air in cooling rooms at storage facilities can further cool the fruit. Where the individual undulations or convolutions are quite large, fruit such as peaches, plums, etc., easily fit into the outwardly turned corrugations of the side wall. Thus, heat conduction from fruit touching the walls further improves the convection cooling of forced air flowing over the corrugated wall surface.

A preferred regular, polygonal form of all of the boxes is square so that each side of one set is identical to any of the other three sides in spacial frequency, phase and amplitude. A square form permits optimum use of both truck bed and storage space for filled boxes.

A particular advantage of square boxes, as distinguished from rectangular, or other polygonal shapes, is the ability to stack or nest any box simply by observing the respective coding of the two sets of boxes without rotation or other manipulation.

Another preferred polygonal shape of containers is substantially circular, (being formed with say 30 square waves formed about a circle). Such circular containers are particularly useful where they can be conveniently manually handled or hook lifted, as by hoops or bails, to form buckets or pails. In such an embodiment of the invention, the undulations forming a single continuous side wall, the corrugations of one set of containers is substantially out of phase at all portions of the complementary walls of the other set. For example, the corrugations of the wall in one set of pails may be double the frequency of the complementary walls of the other set of pails. Such a construction is particularly advantageous with pails since no lids need be fitted or removed to permit stacking as with conventional stackable pails.

Other objects and advantages of the present invention will become apparent from the following description of preferred embodiments taken with the drawings which form a part of this specification.

DESCRIPTION OF DRAWINGS

Referring now to FIG. 1, there is shown a pair of complementary boxes or containers, 10 and 11, constructed in accordance with this invention. The letters "B" (for black) and "W" (for white) respectively marked on containers 10 and 11 indicate one form of coding that can be used to indicate the complementary forms by visual inspection. The undulations 14 in sidewalls 12 of upper box 10 permit it to stack on top of box 11 whose sidewalls 13 have undulations 15 that are complementary to those on box 10. As will be explained later, box 10 will nest with other boxes, similar to 10, whose sidewalls 12 have substantially the same undulations 14 in spacial frequency, including amplitude and phase along sidewall 12 as those of box 10. Similarly, complementary box 11 will stack with similar boxes 11. In general, undulations 15 of box 11 are similar in spacial frequency and amplitude to undulations 13 of box 10, but the phase of the undulations is sufficiently different so that interference between each full wave, such as 16, of sidewall 12, interferferes with the complementary full wave 17 of sidewall 13. Preferably, each portion of wave 16 is 180° out of phase with each complementary portion of wave 17. To permit stacking of similar sets of boxes 10 with each other the four sides are substantially identical in length (i.e., square) and the spacial distribution of undulations 14 in each side 12 is similarly identical. As will also be explained later, it is not important that the undulations 14 be regular (single frequency) but only that the wave train 18 formed by all undulations 14 be similar and that the complementary wave train 19 formed by all undulations 17 in complementary boxes 11 be sufficiently different in frequency or amplitude or both, so that interference is created between the upper surface 26 of lip member 22 of box 11 and bottoms 38 of outgoing ribs or undulations 34 of box 10. Similarly, if box 11 were on top, rather than on the bottom as shown, the bottoms 39 of outgoing ribs 35 would seat on upper surface 24 of lip member 20 on box 10.

Figure 1:
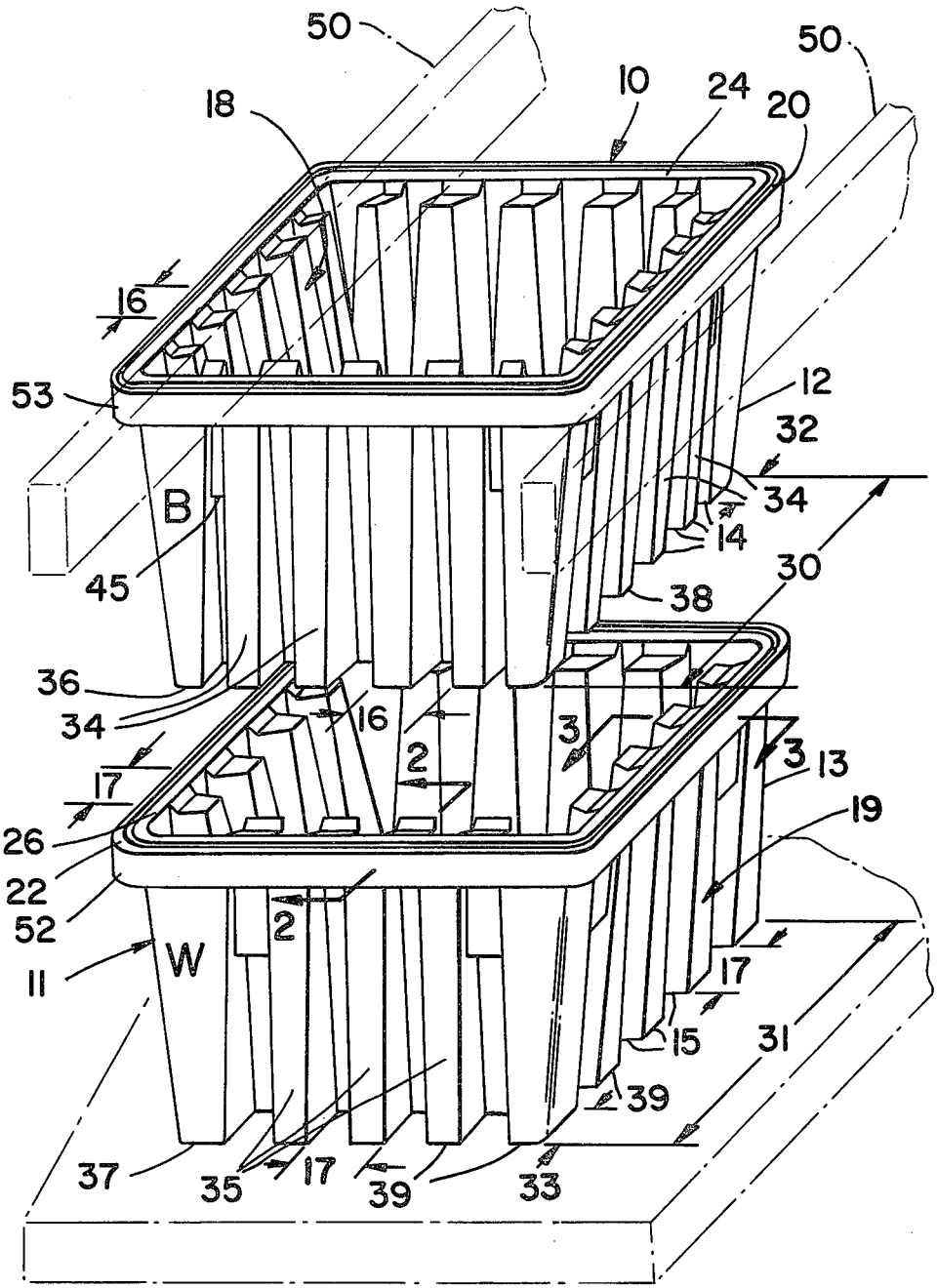
FIG. 1 is a perspective view of a system of tote or lug boxes formed in accordance with the present invention wherein an upper square box is shown in a stacking position relative to lower complementary square box.

As indicated in FIG. 1, in box 10, spacial amplitude and the spacial wave length of each undulation 16 are small relative to the length 30 of sidewall 12. Similarly, in box 11, each spacial wave 17 is small in amplitude and length relative to the length 31 of sidewall 13. In this embodiment of the invention, the respective spacial amplitudes 32 and 33 of undulations 16 and 17, respectively of sidewalls 12 and 13, are shown to be horizontal excursions in the sidewalls forming the vertically tapered ribs 34 in 12 and 35 in 13. As indicated, the sidewalls 12 and 13 of the respective containers are tapered inwardly from the open top formed by lip members 20 and and 22 toward the closed bottoms, respectively 36 and 37 of boxes 10 and 11.

Figure 2:
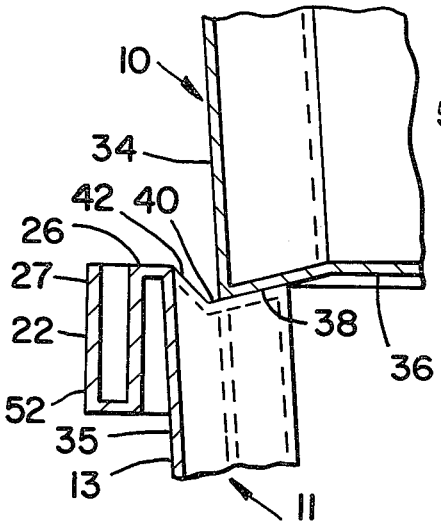
FIG. 2 is a view in the direction of arrows 2—2 in FIG. 1, illustrating the inclined indexing step on the top lip member of a lower container in registration with the bottom of an upper stacked box.

Futher, it is to be noted that the spacial amplitudes and spacial wave lengths of the sidewalls 12 and 13 are large relative to the thickness of the material forming these sidewalls. This is best seen in both FIGS. 2 and 3 which respectively illustrate details of construction of the upper and lower portions of complementary stacking boxes as in FIG. 2 and similar nesting boxes in FIG. 3. FIG. 2 particularly shows the details of lip member 22 of box 11 surrounding sidewall 13 to form the upper landing surface 26. As particularly indicated, lip means 22 includes a registration step 40 that has a tread 38 inclined downwardly and outwardly to a riser 42 that extends upwardly to an enclosing band 27 which completes upper complementary landing surface 26 of lip member 22. Bottom 36 of complementary stacking box 10 includes a matching configuration at the lower end or bottom 38 of each rib 34. For strength in the construction of each bottom, such as 36, landing bottom edge 38 is inclined upwardly and inwardly from wall 12 in manner similar to registration step 40. With bottom 36 recessed upwardly relative to lower ends 38, the entire container bottom is strengthened against buckling when loaded. The lower surface of box bottom 36 may also inclue reinforcing ribs (not shown) so long as they do not interfere with either nesting or stacking of the containers or boxes.

Figure 3:
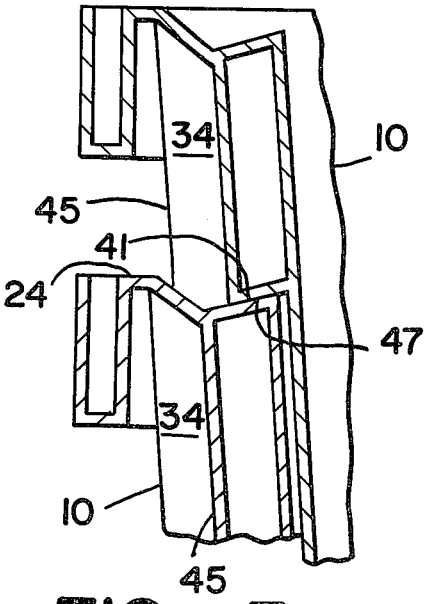
FIG. 3 is a view in the direction of arrows 3—3 in FIG. 1, showing the details of one of the stop members to prevent frictional binding or wedging of identical boxes when nested together.

With regard to FIG. 3, there is shown details of construction of internal ledges or steps to prevent jamming of similar boxes, such as 10, when nested rather than stacked. One suitable way to prevent such sticking or jamming is to provide external stops 45 within one or more of the inwardly going portions of undulations 14. As indicated, two stops 45 on each side wall 12 are quite satisfactory. In forming box 10, for example, stop 45 extends downwardly from lip member 20 about 10 to 30% of the overall height of sidewall 12. In the present embodiment, stop member 45 is 25% of the vertical length of sidewall 12. With stop 45 located near lip member 20, bottom 47 of stop 45 lands on the landing surface 24 and registers with registration step 41 (similar to step 40 in box 11) formed by the top of an inwardly going portion of undulation 14, such as rib 34, since in the nesting mode of operation, the boxes 10 (or 11) are identical.

To permit easy lifting and holding of individual boxes by the tines or forks of a lift truck, such as tines 50, (shown in phantom in FIG. 1) lip means 20 is formed to extend outwardly from and surround the perimeter or circumference of container 10. This configuration of lip means 20 may be a solid bar, but for weight and strength considerations, it may be formed in an L-shape with a downwardly turned flange 52 on lip 22 as in FIG. 2. Lip members 20 and 22 of box 10 and 11 respectively surround the periphery of all corrugations, or undulations 14 or 15 to envelop the outer extremities of all ribs 34 or 35, of boxes 10 and 11 respectively.

As mentioned above, when box 10 is loaded with fruit and is being lifted by means of fork lift tines 50, it is difficult to reorient the box prior to stacking on a complementary box 11 or vice versa. Accordingly, the present invention makes possible a proper selection of box 11 by visual means, such as by colors or other obvious visual markings, such as the letters "B" on box 10 and "W" on box 11, either permanently molded or formed in the box wall. Alternatively, other clearly distinguishing visual features may be used, e.g. different solid colors, stripes, polka dots, varigated colors, etc. Further, the gross appearance of the undulations in the sidewalls may be adequate to distinguish the complementary boxes without other indicia.

Referring now to the modifications in the forms of corrugations, or undulations, such as 34 in sidewall 12, in FIG. 1, FIGS. 4 to 8 illustrate a few examples of many different forms that the individual sinusoids of the sidewalls may take within the teaching of this invention. For example, in FIG. 4, full lines 56 and 58 indicate two adjacent wave trains forming two of the four identical side walls of box 62, as viewed in vertical plan view, each of which is formed by identical sine waves of constant spacial amplitude and frequency. For nesting, the waves of each of the four sides need only begin and end with identical phases, that is, if corner 55 starts from a minimum amplitude in train 56, then corner 57 must also begin from a minimum in adjacent train 58.

As indicated by the dotted sinusoid curves 60 and 61, a stacking box (indicated in phantom by these lines) is of the same frequency, but a different spacial phase; it also may desirably be formed monotomic in amplitude and frequency (to preserve storage room within container, or box 62). The cross-hatched areas 64 on upper lip 66 of box 62 indicates the landing areas or surfaces for such a complementary box having the sine wave configurations 60 and 61 forming its four identical sidewalls.

Figure 4:
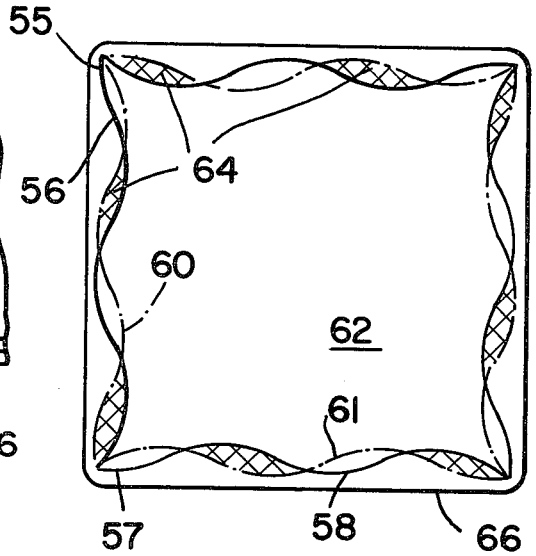
FIGS. 4 to 7 illustrate various modifications in the outer dimensions of generally polygonal boxes formed in accordance with this invention and specifically show alternate shapes of the spacial waves that form side walls of similar and complementary sets of boxes.
Figure 5:
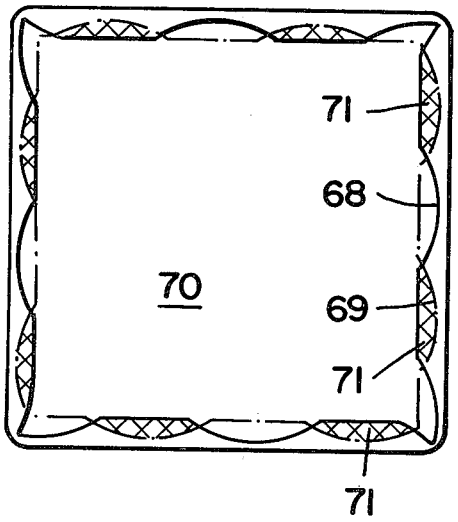

FIG. 5 is similar to FIG. 4 and represents another form of sinusoids wherein the spacial wave trains 68 and 69 of complementary boxes 70 and 71 have flattened peaks on each in-going half wave or corrugation. As in the other embodiments of the invention, the waves 68 and 69 are out of phase sufficient to provide necessary interference as indicated by cross-hatched areas 71 so that box 70 will stack on box 71, or vice versa.

In the forms of sinusoidal waves described in connection with FIG. 5, the wave trains are similar to those seen in the FIG. 4 configuration, but the tops or inwardly going portions of ribs are flattened at the peaks to increase storage space in box 70.

Figure 6:
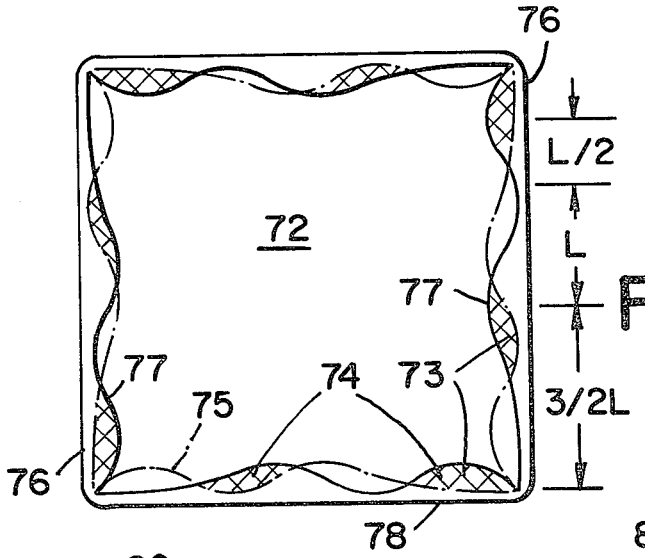

FIG. 6 illustrates a further modification of the corrugations or wave trains in which the amplitude of each half wave is substantially identical, but the spacial frequency or wave length varies along the sidewalls 76 and 78. For example, the wave-length increases from top to bottom as seen in plan view along sidewall 76 as indicated by notations of wave length (L) from L/2 to 3/2L. In accordance with the invention, the other three sidewalls are identical so that boxes 72 will nest with a similar box in any 90° orientation. The complementary box 74 (as indicated by phantom lines) to stack with box 72 will have a similar wave train 75, but train 75 will be sufficiently out of phase with train 77 so that the landing surfaces on the upper lip of 72 are as indicated by hatched areas 73 between dotted line 75 and full line 76. As indicated, the half waves of each train may be 180° spacially displaced from each other for quite satisfactory registry of the bottom of one such box 73 with the top of complementary box 72.

Figure 7:
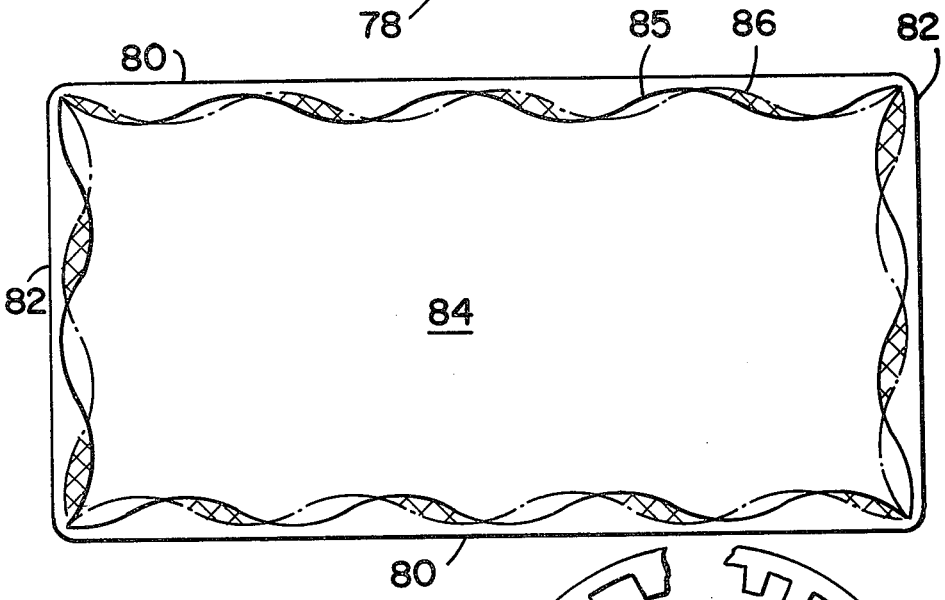

FIG. 7 shows another polygonal shape to which the present invention is applicable. As there shown, a rectangular box 84 may be formed with the two elongated walls 80 of identical spacial frequency and amplitude and the short walls 82 similarly formed. The complementary boxes for stacking are then formed with corresponding frequencies and amplitudes, but with the phases of the corrugations different. In this particular embodiment, obviously, visual identification of the correct 90° orientation will be clear, but colors or other visual codes such as quite diverse frequencies of wave trains 85 and 86 may be desirable to identify which boxes of a pair match for stacking or nesting. It will be apparent that in this embodiment the short sides 82 need not be formed with differently phased corrugations if the full load of the boxes can be borne by long sides 80 alone, or vice versa.

Figure 8:
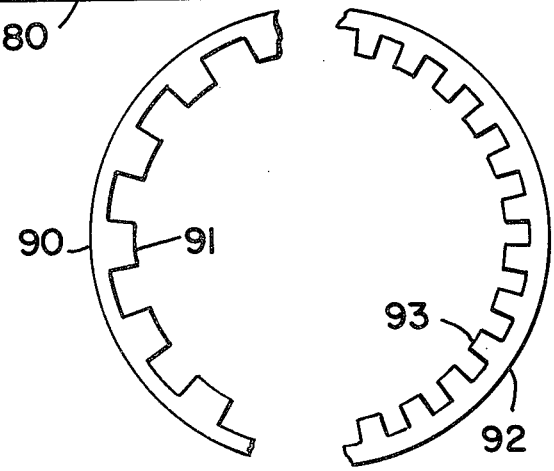
FIG. 8 illustrates substantially circular polygonal boxes or pails adapted to stack or nest with each other.

FIG. 8 is illustrative of a pail or bucket configuration in which two halves of complementary circular, continuous walls 90 and 92, are in a polygonal form to which this invention may be applied. In this embodiment, wave trains 91 and 93 are desirably regular (monotonic) in each container, but the frequency of wave train 93 is double that of the complementary pail's (90) wave train 91 forming its sidewall. As noted before, such a configuration of complementary pails permits stacking without the use (and inconvenience) of lids on a lower pail and without requiring any rotation of one pail relative to the other. The respective pails 90 and 92 may be molded of different colors, or otherwise coded so that complementary pails may be instantly identified for stacking or nesting.

To permit easy sticking, each container is formed with its sidewalls, such as 12, of box 10 (FIG. 1) tapered from top lip 20 inwardly toward bottom 36. The degree of taper is not critical, but something in the range of from about 3° to 10° is suitable for polypropylene (or the like) plastic formed boxes. FIGS. 2 and 3 illustrate this side wall taper in a preferred form.

In summary, this invention contemplates pairs of complementary open-top containers that can be stacked, one upon the other without covers or reorientation of one of the pair relative to the other. The pair of containers are of similar polygonal shape in which the sidewalls are formed as complementary approximations of sine waves (sinusoids) having similar amplitudes, but whose frequencies are spacially displaced sufficiently so that interference is created between the ingoing and outgoing portions of a sufficient number of half waves forming the wave train so that the bottom portions of such waves on one container land on the top of oppositely phased waves on the complementary container. Multiple sets of pairs of boxes are used and only similarly formed containers are identically marked or coded so that a workman (or automatic handling equipment) can readily identify whether a particular container will nest with another container, or stack with a complementary container of the set.

Further changes and modifications within the scope of this disclosure, and the claims forming an integral part of this application, will occur to those skilled in the art. All such modifications coming within the scope of the claims are intended to be included therein.

What is claimed is:

1. A substantially square tote box having an open top, a bottom and substantially identical side walls, said tote box being adapted to nest or stack with a similar tote box, each side wall of said box being formed of similar individual corrugations, each of said corrugations having spatial amplitudes and spacial wave lengths that are small relative to the length, and large relative to the thickness, of said side wall, with the train of individual corrugations forming each of said side walls being identical with the train of the other three sides of said box in number of corrugations and spacing of said corrugations from the edge of the side wall when considered in relation to movement in a clockwise direction around the periphery of the box, and each of said corrugations being tapered inwardly from said open top toward said bottom, and a lip member surrounding said open top forming a landing surface surrounding the periphery of each of said corrugations and thereby enveloping the outer extremities of all said individual corrugations in said landing surface, and said lip being external to said corrugations to form a bottom lift or grip surface for handling said box.

2. A tote box in accordance with claim 1 wherein said train of corrugations is sinusoidal in form as viewed from the top of said box.

3. A tote box in accordance with claim 1 wherein said corrugations are sinusoidal in form as viewed from the top of said box, with each of said sinusoids being formed with flattened peaks.

4. A tote box in accordance with claim 1 in which each of said train of individual corrugations forming each sidewall is substantially monotomic in frequency and amplitude.

5. A tote box in accordance with claim 1 in which each of said trains of individual corrugations change identically in form along the length of each side.

6. At least two tote boxes as defined in claim 1 wherein one of said tote boxes includes a train of corrugations in which the wave lengths and amplitude are substantially identical to the wave length and amplitude of the train of corrugations of the other of said tote boxes, but the phases of said two tote boxes are in substantial interference with each other so that said two tote boxes may be stacked on top of each other in any 90 degree position relative to each other.

7. Tote boxes in accordance with claim 6 in which one of the complementary tote boxes has sidewalls whose corrugation wave train is substantially 180° out of phase with the wave train of the sidewalls of the other of said complementary tote boxes.

8. Tote boxes in accordance with claim 6 in which the exterior side walls of one of said boxes is visually coded differently than the side walls of the other box to indicate by inspection that said differently coded boxes are stackable one upon the other and that the similarly coded boxes are nestable with each other.

9. A substantially square tote box having an open top, a bottom and substantially identical side walls, said tote box being adapted to nest with a similar tote box, or stack with a complementary tote box, each side wall of said box being formed by an identical train of generally square waves, each of said square wave trains having a spatial amplitude and a spatial wave length that is small relative to the length of said side wall and large relative to the thickness of said side wall, with the train of square waves forming each of said side walls being identical with the other three sides of said box in number of waves and spacing of said waves from the edge of the side wall when considered in relation to movement in a clockwise direction around the periphery of the box, and each undulation of said train being tapered inwardly from said open top toward said bottom, and a lip member surrounding said open top forming a seating surface and enveloping the periphery of each of said undulations to thereby enclose the area of the inwardly going portion of each undulation, and said lip extending laterally outward from the side of said corrugation, so that the under surface of said lip member forms a bottom lift or grip surface for handling said box.

10. A system for stacking sets of nestable tote boxes without requiring either 90 degree or 180 degree reorientation for such stacking or nesting which comprises forming two sets of substantially square boxes, each box having a bottom, an open top and four identical side walls, each wall of each set of boxes being similarly tapered from said open top toward said bottom, one of said two sets of boxes having each box of said set having each of its four side walls formed by a train of approximately square waves whose spacial amplitude and spacial wave length are small relative to the length of said side and said spacial amplitude and spacial wave lengths are large relative to the thickness of the wall of said side, the number of square waves in each side wall and spacing of said waves from the edge of said side wall, when considered in relation to movement in a clockwise direction around the periphery of the box, being identical to those in the other three side walls, the other of said sets of boxes having each box of said other set having each of its four side walls being identical and formed by a train of approximately square waves of identical spacial amplitude and spacial wave length of the side walls of boxes of said one set but of sufficiently different spacing from the edge of the wall so that substantial interference is created between the inward and outward convolutions of each cycle of said square waves in said one set and boxes of said other set when one box of either of said sets is stacked upon a box of the other set, and a lip enveloping the open top of each box in both of said sets so that the underside of said lip forms a bottom lift surface for stacking said one box of one set upon a box of the other set without reorientation through 90 degrees or 180 degrees of either box.

11. A system in accordance with claim 10 wherein the exterior side walls of all of the boxes of one set are coded differently than the exterior side walls of boxes of the other set to permit ready segregation for nesting of boxes in one set with each other or stacking with individual boxes from the other set without rotation of any of said boxes about a vertical axis.

12. A system for stacking sets of nestable tote boxes without requiring reorientation of said boxes relative to each other for such stacking or nesting which comprises forming two sets of similar polygonal boxes, each box in both sets having a bottom, an open top and similarly dimensioned side walls and each side wall being tapered from said open top toward said bottom, one of said two sets of boxes having each box of said set having each of its similar side walls formed by corrugations identical in number and spacing thereof from the edge of the side wall when considered in relation to movement in a clockwise direction around the periphery of the box, whose spacial amplitude and spacial wave length are small relative to the length of said side and large relative to the thickness of the wall of said side, the other of said sets of boxes having each box of said other set having each of its similar side walls formed by identical corrugations of identical spacial amplitude and spacial wave length of the complementary side walls of boxes of said one set but of sufficiently different spacing from the edges of the walls so that substantial interference is created between the inward and outward corrugations of each side of said boxes in said one set and the corrugations of similar sides of boxes of said other set, means for coding the exterior side walls of all of the boxes of the other set to permit ready segregation for nesting of boxes in one set with each other or stacking with individual boxes from the other set without rotation of said boxes about a vertical axis, and lip means extending outwardly from the side walls and enveloping the open top of each box in both of said sets to form a bottom lift surface for stacking said boxes of one of said sets with boxes of the other set or nesting with boxes of the same set without reorientation of said boxes relative to each other.

13. A system for stacking open-top nestable containers without requiring covers or reorientation of such containers relative to each other which comprises forming at least a pair of containers of similar external shape, each container having a bottom, an open top and similarly dimensioned sidewalls, each sidewall being tapered inwardly from said open top toward said bottom, one container of said pair having its sidewall formed by corrugations whose spacial amplitude and spacial wave length are (1) small relative to the extent of said sidewall, and (2) large relative to the thickness of said sidewall, and the other container of said pair having its similarly dimensioned sidewall formed by corrugations whose spacial amplitudes are (1) small relative to the extent of said sidewall, and (2) large relative to the thickness of of said sidewall and whose spacial wave length differs sufficiently from said one container to create substantial interference between inwardly going and outwardly going portions of said corrugations forming the sidewalls of said pair of containers, and lip means enveloping the open top of both boxes, the inner edge of said lip means including outwardly inclined registration step means for receiving the outer edges of the interfering corrugations at the bottom of the other container, irrespective of which container of said pair is stacked upon the other and without need to rotate either container relative to the other for such stacking registration.

14. A system of stacking containers in accordance with claim 13 wherein said containers are formed with substantially circular sidewalls.

15. A system in accordance with claim 13 wherein said containers are formed with substantially rectangular sidewalls, each pair of parallel sidewalls being identical to each other in said one container with at least one pair of said parallel sidewalls thereof including said corrugations, and each pair of parallel sidewalls being identical to each other in the other of said containers with at least one pair of said parallel sidewalls thereof being formed with corrugations complementary to the corrugations of said at least one pair of sidewalls of said one container.

16. A system for stacking open-top nestable containers without requiring covers or reorientation of such containers relative to each other which comprises at least a pair of containers of similar external polygonal shape, each container having a bottom, an open top and similarly dimensioned side walls, each side wall being tapered inwardly from said open top toward said bottom;

one container of each of said pairs having a plurality of side walls, each of said side walls being formed with a train of corrugations, each of said corrugations extending substantially vertically along at least a portion of each side wall, said corrugations in each side wall being identical in number, phase, frequency and amplitude, with the spacing of said corrugations from an edge of the side wall being identical to that in the next adjacent side wall in a clockwise direction around said polygonal shape to permit nesting thereof in any position of said side walls relative to another identical container, the other container of each of said pairs having a plurality of side walls similar to said one container and a similar train of corrugations formed in said side walls of said other container, with the corrugations in each side wall being identical to those in the other side walls in number phase, frequency, amplitude and spacing from the edge of the side wall to permit nesting of said other container in any position of said side walls relative to the side walls of another identical container, but said other container side wall corrugations being sufficiently different in at least one of the characteristics of phase, frequency, amplitude or spacing from the edge of the side wall from the same characteristics of said one container so that either said one container or said other container may be stacked upon each other, and lip means surrounding the open tops of said corrugations of each container forming lift means for each container.

* * * * *